United States Patent [19]

Bullard et al.

[11] Patent Number: 4,917,505

[45] Date of Patent: Apr. 17, 1990

[54] COMBINATION MAT, CARRYING BAG AND VISOR

[76] Inventors: Cheryl F. Bullard; Roger D. Bullard, both of Rte. 1, Box 32A, Billingsley, Ala. 36006

[21] Appl. No.: 299,052

[22] Filed: Jan. 19, 1989

[51] Int. Cl.[4] ..... A45C 3/10

[52] U.S. Cl. ..... 383/4; 190/1; 5/416

[58] Field of Search ..... 383/4; 190/1, 2; 5/416, 5/418

[56] References Cited

U.S. PATENT DOCUMENTS

| | | | |
|---|---|---|---|
| 1,172,204 | 2/1916 | Gerhardstein | 383/4 X |
| 1,602,941 | 10/1926 | Rosman | 5/416 X |
| 1,670,460 | 5/1928 | Leibold | 5/416 |
| 2,413,828 | 1/1947 | Hirsch et al. | 383/4 X |
| 2,543,597 | 2/1951 | Peery | 383/4 X |
| 2,735,716 | 2/1956 | Shimabukuro | 5/416 X |
| 2,908,020 | 10/1959 | Barton | 383/4 X |
| 3,477,552 | 11/1969 | Goldman | 190/2 |
| 4,197,891 | 4/1980 | Comollo | 190/2 X |
| 4,566,130 | 1/1986 | Coates | 383/4 X |
| 4,796,734 | 1/1989 | Distasio | 383/4 X |

FOREIGN PATENT DOCUMENTS

| | | | |
|---|---|---|---|
| 141662 | 6/1951 | Australia | 5/416 |
| 1116285 | 5/1956 | France | 190/1 |

*Primary Examiner*—Stephen Marcus
*Assistant Examiner*—Jes F. Pascua
*Attorney, Agent, or Firm*—Richard C. Litman

[57] ABSTRACT

A combination mat, carrying bag and visor includes a substantially rectangular pad having an outer layer of liquid-impervious material and an inner cushioning layer of plastic foam or the like, the pad having a plurality of sections interconnected by fold lines so that the pad in the planar condition serves as an infant diaper changing pad, with releasable fastening strips being provided in a selected arrangement on the various sections of the pad to permit the pad sections to be folded into overlying relationship forming a bag having a closure flap or, into a U-shaped configuration to serve as a sun visor on an infant carrier such as a stroller or the like, with fastening strips being provided which may be attached to the carrier and interengage with the fastener strips on the pad to hold the pad in the visor position. The pad includes a pocket containing a netting which may be withdrawn and used as an insect barrier for the infant in the carrier.

4 Claims, 2 Drawing Sheets

COMBINATION MAT, CARRYING BAG AND VISOR

FIELD OF THE INVENTION

The present invention pertains to a combination mat which can be used as an infant diapering pad and which is convertible to an infant accessory carrying bag and visor attachable to a carseat, infant stroller and the like.

BACKGROUND OF THE INVENTION

Body-cushioning pads or mats, including those useful as infant diapering pads, and which are convertible to carrying bags are, in general, well-known. However, the prior devices in this field have been unnecessarily complex, cumbersome to fold and carry, expensive and otherwise inconvenient to use.

DESCRIPTION OF THE RELATED ART

One such combined mat and bag unit is shown in U.S. Pat. No. 4,738,545 issued to Westgor. The Westgor patent discloses a unit comprising a sheet of pliable material which defines a mat of a size for use as an exercise mat, beach mat or the like. The sheet has a drawstring casing extending about its periphery with two openings on opposite sides of the mat. A drawstring is received in the casing and extends continuously about the periphery of the sheet when it serves as a mat. When the drawstring portions are pulled out through the openings, the sheet periphery forms gathers, thereby thus reducing the size of the unit to form a carrying bag. The portions of the drawstring which are pulled out are secured together to form a bag-carrying handle.

In U.S. Pat. No. 4,671,393 issued to Rainey, there is disclosed an equipment-carrying bag comprising inner and outer units which unfold to form mats. The mats can be secured to each other to increase the size and webbing attached to the covering of the outer unit to provide a carrying handle and to provide support when the unit is used as a bag.

A convertible tote bag for holding articles is also disclosed in U.S. Pat. No. 4,723,300 issued to Aranow. This bag comprises zipper-connected front and rear panels which when disconnected can be folded flat. A moisture-absorbing pad is thereby exposed whereby the unit can serve for infant diapering. The pad is releasably secured to the panels, and a moisture-impervious layer is releasably attached between the panels and the pad to protect the panels from becoming wet or soiled. Carrying handles and pockets are also provided.

An assembly of particular interest in the field of the present invention is shown in U.S. Pat. No. 4,566,130 issued to Coates wherein a combination carrying bag for infant accessories and diapering station is disclosed. It comprises a diapering station formed of a single piece of material divided by fold lines into three successive sections to cushion an infant on a support surface and store infant accessories. The station is converted into a carrying bag by folding the two end sections inwardly, one over the other along fold lines, and onto the middle section thus enabling the bag to be carried by a combination handle- and-backpack strap. A removable pouch used to store items is in the middle section. One of the end sections also contains a pocket for storage of items such as bottles.

U.S. Pat. No. 4,606,087 issued to Alivizatos discloses a support pad or cushion comprising a flexible fabric cover partially filled with expanded plastic beads. One embodiment is convertible to a carrying bag for infant articles and the like, and another embodiment includes a plurality of bags enclosed in a segmented cover for use as a mattress, pool float, chair or the like.

These and other prior art assemblies disclose various types of combined mat and carrying bag devices. However, none of them, taken singly or in combination, disclose the specific details of the present invention in such a way as to bear upon the claims thereto.

SUMMARY OF THE INVENTION

By the present invention, an improved combination mat, carrying bag and visor attachment is provided which readily lends itself to multiple uses. In general, the invention relates to a combination carrying bag for infant accessories, infant diapering pad and visor attachment for infant strollers, carseats and the like. The device is formed of a single piece of insulating cushioning material divided into a plurality of sections by fold lines. When the device is laid flat it may be used by way of example for diaper changing, wherein the infant is both cushioned and insulated. To convert the device to a carrying bag, the sections are folded inwardly, one over the other, along the fold lines, sealed and carried by the attached strap. When folded, as noted, it can serve for example as an insulated infant bottle holder or to hold various other articles, such as rattles, toys, etc.

More particularly, the present invention provides an assembly comprising a single piece of material of generally rectangular shape and of a size sufficient to hold an infant, and is divided into three successive sections by fold lines. The middle section is further divided into three successive sections by seams forming fold lines. The unit is laid flat on a support surface to cushion an infant during diaper changing. In its substantially fully folded position on a carrying bag for articles is provided, and in a partially-folded position a visor for attachment to infant-carrying devices such as a stroller is provided. To convert it to a carrying bag, the two end sections are folded inwardly, one over the other, onto the middle section and secured with releasable fastening means such as, for example VELCRO strips. One end of the middle section is folded along a fold line and secured to the folded end sections to form the bottom of the bag. The other end of the middle section can similarly be folded and attached to the folded end sections to form the top of the enclosed bag. The assembly can further serve as a visor attachment for infant strollers, etc. by folding the end sections and attaching with fastening means, such as VELCRO strips. An auxiliary pocket is provided in the middle section to contain, for example, a netting which may be used to protect an infant from insects.

Accordingly, it is an object of the present invention to provide a combination diapering pad, carrying bag and infant vehicle visor of a single piece of material.

Another object of the invention is to provide an insulated carrying bag for infant bottles for maintaining such bottles at an essentially constant temperature to prevent spoilage of the bottle contents.

A still further object is to provide a visor for infant vehicles and carrying devices which also can be adapted to store a netting which may be used to protect infants from insects.

An additional object is to provide a combination carrying bag, diaper-changing pad and visor that is simple and inexpensive in construction, durable and easy to use.

With these and other objects in view which will more readily appear as the nature of the invention is better understood, the invention consists in the novel construction, combination and assembly hereinafter more fully illustrated, described and claimed with reference being made to the accompanying drawings.

BRIEF DESCRIPTION OF THE DRAWINGS

Similar reference characters designate corresponding parts throughout the several figures of the following drawings.

DESCRIPTION OF THE PREFERRED EMBODIMENT

Figure 1:
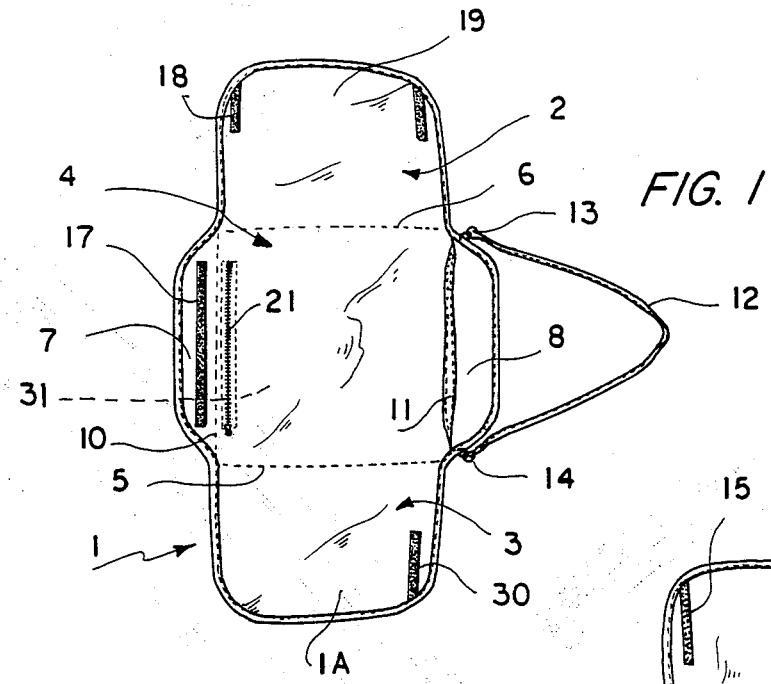
FIG. 1 is a plan view of one side of the combination diaper-changing pad, carrying bag and visor of the invention.
Figure 2:
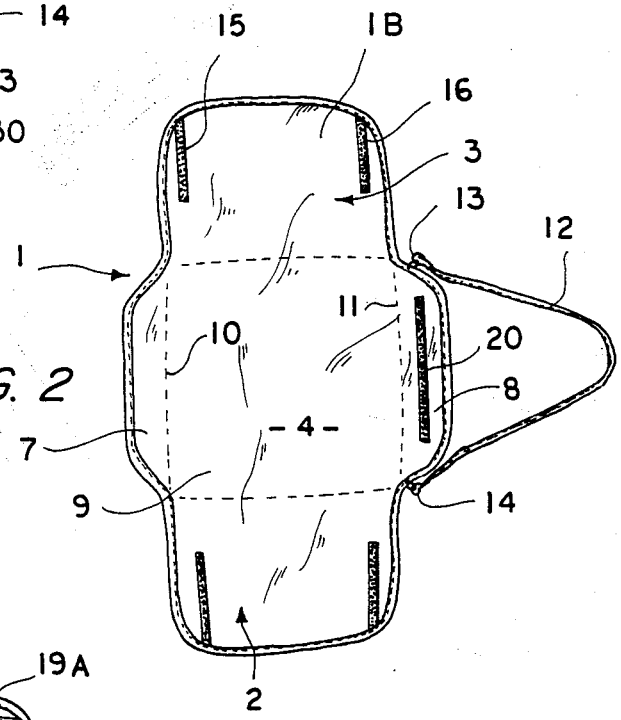
FIG. 2 is a view similar to FIG. 1, of the other side of the invention.

Referring now to the drawings, FIGS. 1 and 2 show the device of the present invention in its unfolded diaper-changing pad form which is designated by the numeral 1. It may be constructed of fabric, plastic or waterproof materials of the type conventionally used in the construction of diaper-changing pads. Preferably, a urethane-type foam with a medium weight waterproof vinyl covering is utilized.

The pad 1 has three primary interconnected panels or sections, comprising outer sections 2 and 3 joined to a middle section 4, with the three sections 2–4 separated by intermediate fold lines 5 and 6 which may be a seam or the like, adapted to define and facilitate folding therealong. Middle section 4, which is larger than the end sections 2,3 as illustrated in Figs. 1 and 2, is further divided transversely into three successive sections 7, 4 and 8 separated by fold lines 10,11 which may also be seam lines. The outer surface of the open pad 1, as in FIG. 1 is designated 1*a* while the reverse or inner surface, as in FIG. 2 is identified 1*b*. A carrying strap 12 is removably attached to the pad 1 adjacent one edge of a middle section 4 by fastening means, such as hook 13 and 14. The strap 12 functions as a carrying handle or strap when the diaper pad 1 is folded to form the carrying bag embodiment of this invention.

Figure 3A:
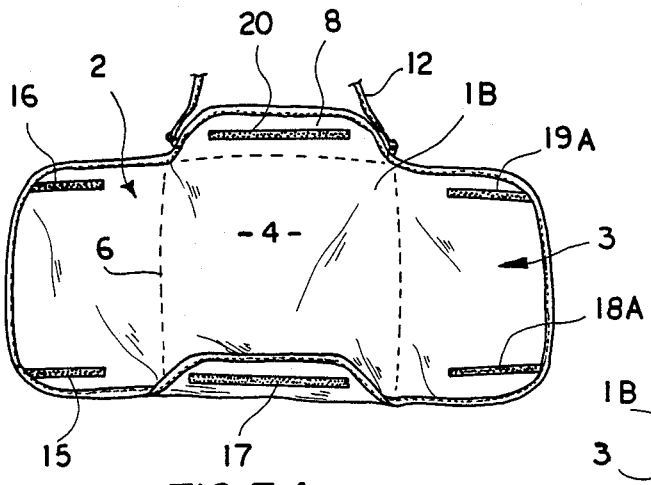
FIG. 3A is a further view of the invention showing one folding step for converting the invention from a diaper-changing pad to a carrying bag.
Figure 3B:
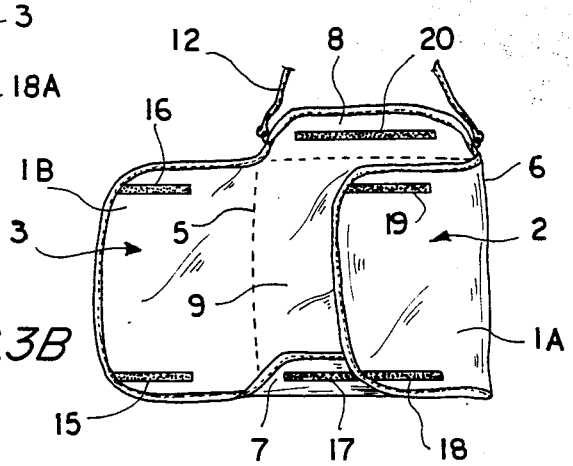
FIG. 3B is a view showing another folding step subsequent to the step shown in FIG. 3A.
Figure 3C:
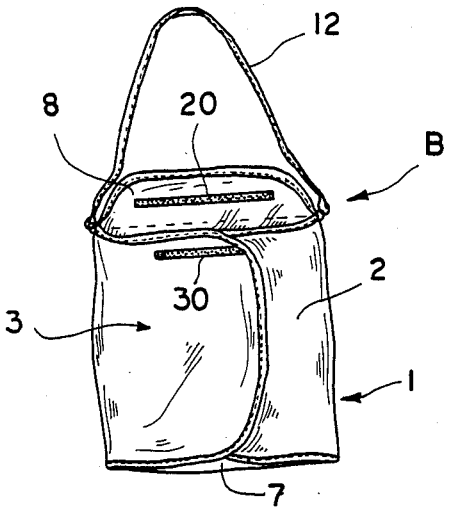
FIG. 3C is a view showing the final folding step subsequent to the step of FIG. 3B.
Figure 4:
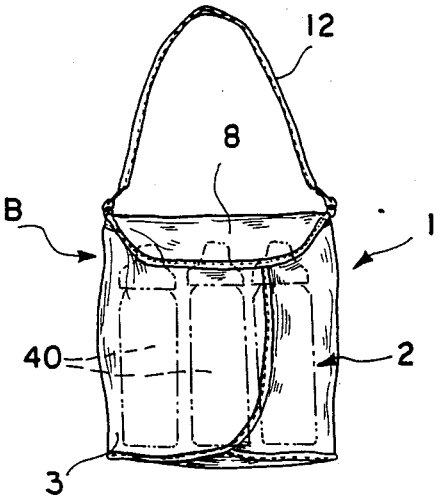
FIG. 4 is a front view of the insulated carrying bag formed from the invention with infant bottles stored therein.

Starting with the pad 1 in the position of FIG. 2, the bag configuration as shown in FIG. 4 is formed by first folding bottom section 7 inwardly along fold line 10 onto middle section 4 as shown in FIG. 3A. First end section 2 is then folded onto middle section 4 along fold line 6 as shown in FIG. 3B, following which the second end section 3 is folded along fold line 5 over the middle section 4, partially overlapping the previously folded first end section 2 as shown in FIG. 3C. The carrying bag designated generally in FIGS. 3C and 4 by the letter B, is maintained closed by suitable pressure attachable and releasable fastening means, preferably VELCRO strips 15,16 on the inner surface of section 2, VELCRO strips 18,19 on the outer surface of section 3, and VELCRO strip 17 on the outer surface of section 7, all attached adjacent the edges of sections 2, 3, and 7 respectively, as shown most clearly in FIG. 3B. Supplemental fastening strips 18*a*,19*a* may be provided on the outer surface 1*a* of end section 3 to permit the initial folding of either end section 2,3 when forming the bag B.

The VELCRO strip 17 is attached to the pad 1 on the side opposite the side to which VELCRO strips 15 and 16 are attached so that when sections 2 and 3 are folded over they are securely connected. Similarly, fastening means 20 which also may be a VELCRO strip, is attached to the inner pad surface 1b adjacent the edge of section 8 and is used to connect section 8 in closing relationship with the bag B. Section 8 is folded downwardly along fold line 11 over the fastened end sections 2 and 3 to form the enclosed carrying bag B shown in FIG. 4. Note that VELCRO strip 30 is provided on the outer surface 1a of section 3 opposite that of strip 19 on the outer side of section 3, while strip 30 forms the attaching strip for strip 20 on section 8. Obviously other fastening means, such as snaps, etc. could be substituted for the VELCRO strips without departing from the spirit of this invention.

Returning to FIG. 1, middle section 4 is provided with an auxiliary pocket 31 secured by fastening means such as zipper 21 in which various articles may be stored. In accordance with a preferred embodiment, the pocket 31 is disposed adjacent the edge of section 4 opposite that of carrying strap 12, and preferably contains a netting 32 attached to the inside thereof as described hereinafter.

Figure 5:
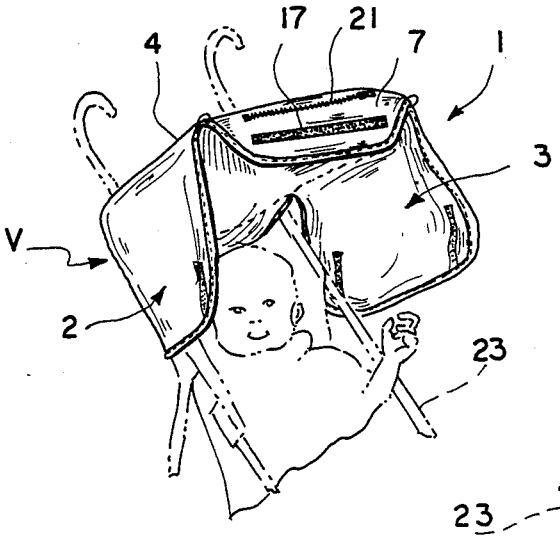
FIG. 5 is a view of the invention attached to an infant stroller illustrating its use as a visor.
Figure 6:
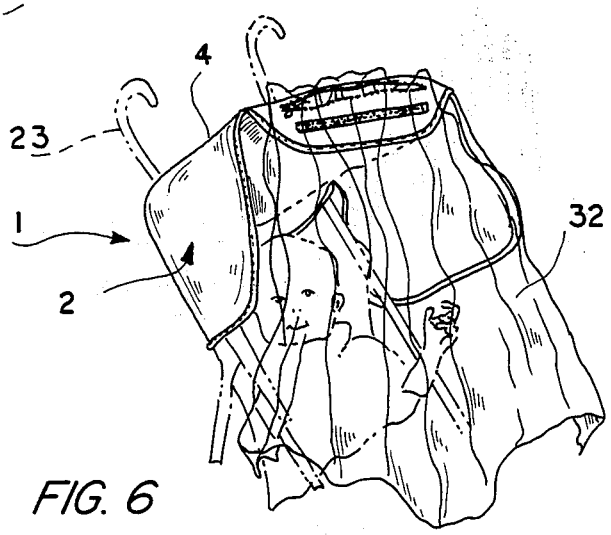
FIG. 6 is another view similar to FIG. 5, showing the netting stored in the invention in an operative position.

FIGS. 5 and 6 illustrate a further embodiment of the present invention wherein the invention is utilized as a visor designated by the letter V. In FIG. 5, the visor V is shown attached to the frame or handles of a conventional infant stroller 23. FIG. 6 similarly shows the visor V attached to an infant stroller 23. To form the visor V, the end sections 2 and 3 are folded downwardly as shown in FIGS. 5 and 6 and attached to the stroller by fastening means such as the described VELCRO strips 16 and 16*a*. In FIG. 5, the zipper 21 is manipulated to open the pocket 31 in the middle section 4 of the invention. As noted above, the pocket 31 preferably contains an attached netting 32 which may be pulled from the pocket and which serves to cover and thereby protect an infant from insects, as shown in FIG. 6. Obviously, the pocket 31 could also be used to hold various accessories.

The invention provides an assembly that is versatile, easy to use, compact and lightweight. It will be seen from the foregoing that an assembly is provided which enables a user to readily adapt a single, unitary apparatus to a multitude of embodiments. When disposed as in FIG. 1, the pad 1 is coplanar and the entire outer surface 1*a* is usable as a changing station upon which an infant's diaper may be changed. By turning the pad 1 over to place its outer surface 1*b* uppermost, a simple manipulation of its two outer panels or sections 2,3 and the bottom or edge section 7, permits one to fabricate a storage bag B having a closable top as provided by the edge section 8. In this mode, bottles 40, food or the like may be conveniently stored and transported. The material of which the pad 1 is constructed will be understood to be water repellent and may provide a degree of insulation, thereby protecting chilled or warmed items carried within the bag B. In the remaining embodiment, the same pad 1 is quickly converted to a protective device V, especially adapted for use with a stroller 23 and which permits supporting a netting 32. Thus, an infant may be shielded from the sun, rain or insects by use of the invention in this latter mode. While a preferred embodiment has been described, it is understood that the invention is capable of modifications within the scope thereof without departing from its spirit as recited in the following claims.

We claim:

1. A combination mat, bag and visor comprising, in combination:

a shaped pad of liquid-impervious material, said pad having a plurality of integrally formed sections defined by intermediate fold lines, said sections including a middle section and a pair of oppositely disposed end sections, said middle section including an adjacent top section and bottom section, first means on said pad for detachably interconnecting said end sections in overlying relationship with each other and said central section, second means for detachably interconnecting said top section in overlying relationship with said end sections in said overlying relationship, third means for detachably interconnecting said bottom section in overlying relationship with said end sections in said overlying relationship, a pocket in said middle section and manipulable closing means for said pocket, an insect barrier netting having a portion attached to the interior of said pocket.

a plurality of VELCRO strips, and means for attaching said VELCRO strips to an associated baby carrier or the like at selected locations, said pad being adapted to be attached by said VELCRO strips to said carrier in a U-shaped configuration to form a sun visor for a body occupying said carrier.

2. A combination mat, bag and visor in accordance with claim 1, wherein said first, second and third means comprises VELCRO.

3. A combination mat, bag and visor in accordance with claim 1 wherein said pad comprises outer and inner layers of said liquid-impervious material defining an interior therebetween and a layer of cushioning material in said pad interior.

4. A combination mat, bag and visor in accordance with claim 1 including a carrying handle attached to said pad middle section adjacent said top section.

* * * * *